US006645426B1

(12) United States Patent
Yoshihara et al.

(10) Patent No.: US 6,645,426 B1
(45) Date of Patent: Nov. 11, 2003

(54) METHOD AND DEVICE FOR MANUFACTURING POWDER MOLDED BODY

(75) Inventors: Toshiro Yoshihara, Honjo (JP); Mitsuhiro Sato, Matsudo (JP); Tadao Masuda, Kashiwa (JP)

(73) Assignees: Kobayashi Industry Co., Ltd., Honjo (JP); Hitachi Powdered Metals Co., Ltd., Matsudo (JP)

( * ) Notice: Subject to any disclaimer, the term of this patent is extended or adjusted under 35 U.S.C. 154(b) by 0 days.

(21) Appl. No.: 10/031,384

(22) PCT Filed: Jul. 18, 2000

(86) PCT No.: PCT/JP00/04825

§ 371 (c)(1),
(2), (4) Date: Jan. 18, 2002

(87) PCT Pub. No.: WO01/05541

PCT Pub. Date: Jan. 25, 2001

(30) Foreign Application Priority Data

Jul. 19, 1999 (JP) ..... 11/205144

(51) Int. Cl.[7] ..... B22F 3/12
(52) U.S. Cl. ..... 419/38; 425/78
(58) Field of Search ..... 419/38; 425/78

(56) References Cited

U.S. PATENT DOCUMENTS 5,403,373 A * 4/1995 Kitagawa et al. ..... 75/238

FOREIGN PATENT DOCUMENTS

| | | |
|---|---|---|
| FR | 2 607 740 | 6/1988 |
| GB | 2 012 654 | 8/1979 |
| JP | 54-91877 A | 7/1979 |
| JP | 2-16879 Y2 | 5/1990 |
| JP | 7-40094 A | 2/1995 |
| JP | 7-80695 A | 3/1995 |
| JP | 2000-71099 A | 3/2000 |

* cited by examiner

*Primary Examiner*—Daniel J. Jenkins
(74) *Attorney, Agent, or Firm*—Birch, Stewart, Kolasch & Birch, LLP

(57) ABSTRACT

Material powder 17 is filled in a cavity 16 which is composed of a die 12 having a die hole 11 in a shape matching the contour of a green compact and a lower punch 13. The material powder 17 is temporarily compressed by an upper punch 14 and the lower punch 13 to obtain a preform 18. A punch-out pin 15*a* is inserted into the preform 18 to punch out a shape of a through-hole 3. The preform 18 is pressurized and compressed by both of the upper and lower punches 14, 13 to obtain a green compact 19. The punch-out pin 15*a* is pulled out from the green compact 19 and the green compact 19 is taken out from the cavity 16. Further, the green compact 19 is sintered and a pair of leg parts 24 connected continuously at a base part 23 and an undercut part 25 between the leg parts 24 are formed by cutting off a part of a peripheral wall 26 of a through-hole 25*a*. The punched-out material powder 17 is retracted to and stored in the outside of the cavity 16 and refilled into the through-hole 3 after the punch-out pin 15*a* is pulled out. The material powder 17 is removed after the green compact 19 is taken out.

5 Claims, 5 Drawing Sheets

METHOD AND DEVICE FOR MANUFACTURING POWDER MOLDED BODY

This application is the national phase under 35 U.S.C. §371 of PCT International Application No. PCT/JP00/04825 which has an International filing date of Jul. 18, 2000, which designated the United States of America.

TECHNICAL FIELD

The present invention relates to a manufacturing method and a manufacturing device of a green compact having a through-hole at a part connected continuously to a base part or a green compact having a pair of leg parts connected continuously at a base part in which a part between both leg parts is an undercut part.

BACKGROUND ART

Conventional machine parts include P/M (powder metallurgy) product shown in FIG. 1(*a*), FIG. 1(*b*), and FIG. 3(*a*). The product shown in FIG. 1(*a*) comprises a rack 2 at an end of a base part 1 and has an axis hole 3 penetrating a part connected continuously to the base part 1 formed therein. The product shown in FIG. 1(*b*) comprises a hook part 5 at an end of an arm 4 extending from the base part 1 and has the axis hole 3 penetrating the part connected continuously to the base part 1 formed therein.

On the other hand, the product shown in FIG. 3(*a*) is composed of a hook part 22 provided at the front end of a rod part 21 and a pair of leg parts 24, 24 connected continuously at a base part 23 which is the rear end of the rod part 21, and has an undercut part 25 between the leg parts 24, 24.

Methods for manufacturing such a machine part having the axis hole 3 or the undercut part 25 by P/M include a method in which a green compact in a shape without the axis hole 3 or the undercut part 25 is first sintered, and then, the axis hole 3 is provided by drilling work or the undercut part 25 is provided by cutting work and the like, and a method in which the axis hole 3 or the undercut part 25 is provided at the same time of the powder compaction.

As described in the former method, in a case of performing the drilling work or the cutting work on the sintered compact, the powder compacting is performed using a die having a die hole in a shape matching the contour of a desired molded body in a vertical direction and a pair of punches inserted into the die hole from the upside and underside of the die. First, material powder is filled in a cavity which is formed of the die hole and a lower punch inserted into the die hole from the underside of the die. Next, the material powder is pressurized and compressed by the upper and lower punches to a prescribed thickness and the obtained green compact is taken out from the upside of the die hole. The green compact is sintered, and thereafter, the axis hole 3 is formed by the drilling work or the undercut part 25 is formed by the cutting work. In this method, however, the drilling work or the cutting work is time-consuming and requires an extra cost.

On the other hand, in a case of forming the axis hole 3 or the undercut part 25 at the same time as the time of powder compacting as described in the latter method, a powder compacting device is utilized which comprises, in addition to the die and the upper and lower punches, a horizontal punch or a core movable in a direction perpendicular to a pressurizing direction for shaping the axis hole 3 or the undercut part 25.

As for the powder compacting device comprising the horizontal punch for shaping the axis hole 3 or the undercut part 25, a method is known in which the cavity formed of the die hole and the lower punch is filled with the material powder while being penetrated by the horizontal punch, the material powder is compressed to the prescribed thickness by the upper and lower punches, the horizontal punch is pulled out from the obtained green compact, and the green compact is taken out from the upside of the die hole. In this manufacturing method, since the cavity is filled with the material powder while being penetrated by the horizontal punch, the material powder is not uniformly filled into a lower part than the horizontal punch in the cavity, and it is sometimes impossible to shape a green compact especially when it has a shape in which thickness of a periphery of the axis hole 3 or the undercut part 25 (the base part 1 or the leg part 24) is thin.

As for the manufacturing method in which a core in a shape corresponding to the shape of the axis hole 3 or the undercut part 25 is disposed in the cavity in advance, the cavity with the core disposed therein is filled with the material powder, the upper punch is inserted under pressure from an opening of the cavity, and the material powder is pressurized and compressed so as to obtain the green compact. The core is removable from the pressurized and compressed green compact and, by pulling it from the compacted body, the green compact having the axis hole 3 or the undercut part 25 can be obtained. In this manufacturing method, however, it is difficult to obtain the uniform density of the material powder in a lower part and in an upper part than the core when the material powder is filled.

Another method is also known in which the cavity formed of the die hole and the lower punch is filled with the material powder, the material powder is pressurized and compressed by the upper and lower punches, and the axis hole 3 or the undercut part 25 is punched out by a punch-out punch. However, in this manufacturing method, when the green compact obtained by the pressurization and compression is punched out by the punch-out punch, chipping, breakage or the like may be caused in the green compact.

Moreover, if a part of the periphery of the axis hole 3 or the undercut part 25 (the base part 1 or the leg part 24) becomes thin due to the forming of the axis hole 3 or the undercut part 25 as shown in FIG. 1(*b*) or FIG. 3(*a*), both of the manufacturing methods using the core or the punch-out punch have a disadvantage that breakage may be caused in the thin part when the green compact with the axis hole 3 or the undercut part 25 formed therein is taken out. In a case in which the undercut part 25 is formed, there is also a disadvantage that deformation such as warpage may occur in the leg part 24 in sintering which is performed after the powder compaction.

DISCLOSURE OF THE INVENTION

In order to solve these disadvantages, an object of the present invention is to provide a manufacturing method in which a green compact is having a through-hole or an undercut part can be easily manufactured without causing breakage.

Another object of the present invention is to provide a manufacturing device appropriate for the manufacturing method of the green compact having the through-hole or the undercut part.

To achieve these objects, the manufacturing method of the green compact according to the present invention is characterized in that it comprises a step of filling material powder into a cavity formed of a die having in a vertical direction a die hole in a shape matching a contour of the green compact including a through-hole at a part connected continuously to a base part and a lower punch inserted into the die hole from the underside of the die, a step of obtaining a preform by temporarily compressing the material powder filled in the cavity by means of an upper punch inserted from the upside of the die into the die hole and the lower punch, a step of punching out a shape of the through-hole by inserting a punch-out pin having a shape corresponding to a cross-section of the through-hole into the preform, a step of obtaining a green compact by pressurizing and compressing the preform by means of both of the upper and lower punches in a state in which the punch-out pin is being inserted, a step of pulling out the punch-out pin from the green compact, and a step of taking out the green compact from the cavity.

According to the manufacturing method of the present invention, the lower punch is first inserted into the die hole from the underside of the die so that the cavity is formed of the lower punch and the die hole.

The material powder is then filled in the cavity. When the material powder is filled, the upper punch is inserted into the die hole from the upside of the die and the material powder is temporarily compressed between the upper and lower punches so that the preform is obtained. On this occasion, since a core is not disposed in the cavity, the material powder can be filled at uniform density.

The punch-out pin is then inserted into the preform. On this occasion, since the material powder is temporarily compressed as described above, the shape of the through-hole can be easily punched out by the punch-out pin.

Thereafter, the preform is pressurized and compressed by both of the upper and lower punches while the punch-out pin is being inserted into the preform. As the punch-out pin works as a core, the green compact having the through-hole in a shape matching the contour of the punch-out pin is obtained. The preform is obtained by temporarily compressing the material powder which is filled at the uniform density. Therefore, by further pressurizing and compressing the preform, a possibility that the material powder upper than the punch-out pin and that lower than the punch-out pin have different density can be prevented even if the punch-out pin is being inserted.

The punch-out pin is then pulled out from the obtained green compact and the green compact is taken out so that a completed product can be obtained.

The manufacturing method of the green compact according to the present invention is also characterized in that it further comprises a step of sintering the green compact taken out from the cavity and a step of forming a pair of leg parts connected continuously at the base part and an undercut part formed between both of the leg parts by cutting off a part of a peripheral wall which forms the through-hole of the sintered compact.

Although a thin part is formed around the through-hole of the taken-out green compact, the thin part itself is the peripheral wall of the through-hole and connected at a part facing the base part, and thereby deformation is limited in the sintering and warpage or the like can be securely prevented from occurring.

Thus, the green compact having the pair of leg parts connected continuously at the base part and the undercut part formed between both of the leg parts can be obtained by sintering the taken-out green compact and thereafter, cutting off the part of the peripheral wall which forms the through-hole.

If the pair of leg parts are wished to be parallel to each other when the green compact having the leg parts and the undercut part is formed, the through-hole is made to have a pair of parallel parts extending from the base part, a part of the through-hole facing the base part is cut off, and thereby, a second sintered compact having a pair of parallel leg parts connected continuously at the base part can be formed. According to the manufacturing method of the present invention, since the deformation such as the warpage or the like does not occur in the thin part around the through-hole in the sintering described above, an excellent parallel state can be given to the leg parts.

Further, the manufacturing method of this invention is characterized in that it comprises a step of retracting and storing the material powder, which is punched out in said step of punching out a shape of said through-hole by inserting a punch-out pin into said preform, outward of the cavity; a step of refilling the stored material powder into said through-hole from which said punch-out pin has been pulled out in said step of pulling out the punch-out pin from the green compact; and a step of removing the material powder refilled into said through-hole after said step of taking out said green compact from said cavity.

In this manufacturing method, if the through-hole is kept as a hollow after the punch-out pin is pulled out from the green compact obtained by further pressurizing and compressing the preform, the thin part may break when the green compact is taken out Therefore, when the punch-out pin is inserted into the preform to punch out the shape of the through-hole, the punched-out material powder is retracted to the outside of the cavity by the punch-out pin and stored. At the time when the punch-out pin is pulled out from the green compact obtained by the pressurization and compression, the material powder retracted as described above is refilled into the through-hole from which the punch-out pin has been pulled out. Since the retracted material powder is temporarily compressed as described above, it can be refilled into the through-hole easily without losing its shape.

When the green compact is taken out thereafter, the green compact can be taken out without causing breakage because its thin part is reinforced by the material powder filled in the through-hole. The taken-out green compact can then become a complete product by removing the material powder refilled in the through-hole.

The material powder punched out as described above may be collected and recycled instead of being refilled into the through-hole.

The manufacturing method according to the present invention in which the punched-out material powder is refilled into the through-hole as described above can be realized more advantageously by a device for manufacturing the green compact, comprising:

a die having in a vertical direction a die hole in a shape matching a contour of the green compact including a through-hole at a part connected continuously to a base part;

the lower punch inserted from an underside of the die into the die hole and forming a cavity to be filled with the material powder together with the die;

an upper punch inserted from an upside of the die into the die hole and pressurizing and compressing the material powder filled in the cavity together with the lower punch;

a punch-out pin having a sectional shape corresponding to a cross-section of the through-hole, provided in the die to face the cavity, and inserted into a preform formed by temporarily compressing the material powder by means of both of the upper and lower punches to punch out a shape of the through-hole; and a refill pin having a sectional shape corresponding to the cross-section of the through-hole, provided in the die to face the cavity and the punch-out pin, moving backward in synchronization with forward movement of the punch-out pin when the punch-out pin is inserted into the preform, and moving forward in synchronization with backward movement of the punch-out pin when the punch-out pin is pulled out from the preform to refill the material powder into the through-hole.

According to the manufacturing device of the present invention, when the punch-out pin is inserted into the preform to punch out the shape of the through-hole, the refill pin provided to face the punch-out pin moves backward in synchronization with the forward movement of the punch-out pin. As the result, the material powder in the shape of the through-hole which has been punched out by the punch-out pin is sandwiched between the punch-out pin and the refill pin, retracted to a position where the refill pin has been before moving backward, and stored as it is.

Then, when the punch-out pin is pulled out from the preform, the refill pin moves forward in synchronization with the backward movement of the punch-out pin. As the result, the material powder stored in the position where the refill pin has been before moving backward moves while being sandwiched between the punch-out pin and the refill pin so as to be refilled into the through-hole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

BEST MODE FOR CARRYING OUT THE INVENTION

Figure 1:
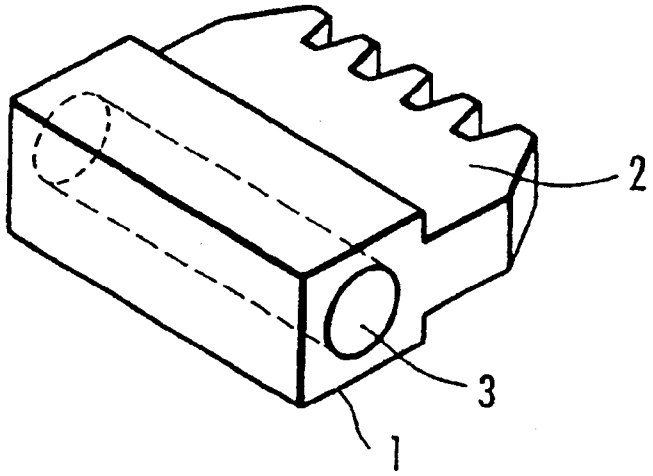
FIGS. 1(*a*) and 1(*b*) are perspective views showing examples of a green compact.
Figure 1:
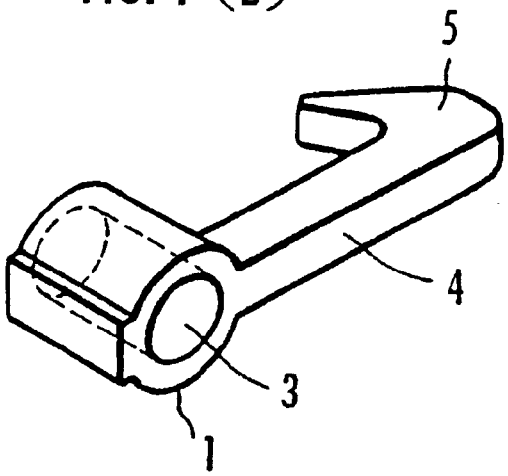

Hereinafter embodiments according to the present invention will be explained in detail with reference to the attached drawings.

First of all, a case of manufacturing a green compact in a shape shown in FIG. 1(*a*) or FIG. 1(*b*) will be explained as an example of a first embodiment of the present invention.

The P/M products shown in FIG. 1(*a*) and FIG. 1(*b*) are used as machine parts as described above, the product in FIG. 1(*a*) comprises a rack 2 provided at an end of a base part 1 and an axis hole 3 formed by penetrating a part connected continuously to the base part 1, and the product in FIG. 1(*b*) comprises a hook part 5 provided at an end of an arm 4 extending from the base part 1 and the axis hole 3 formed by penetrating the part connected continuously to the base part 1.

Figure 2:
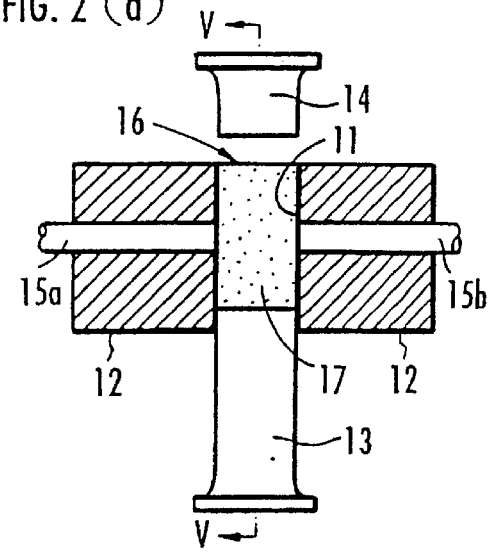
FIGS. 2(*a*) to 2(*f*) are explanatory cross-sectional views showing a manufacturing device and a manufacturing method of the green compact shown in FIGS. 1(*a*) and 1(*b*)
Figure 2:
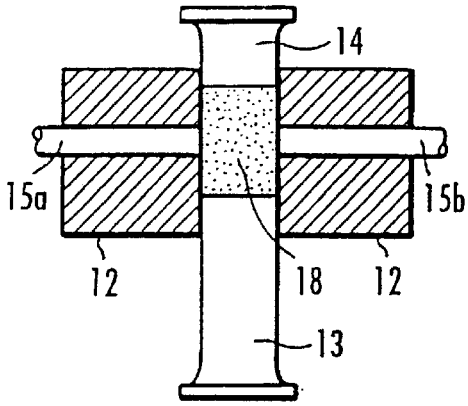
Figure 2:
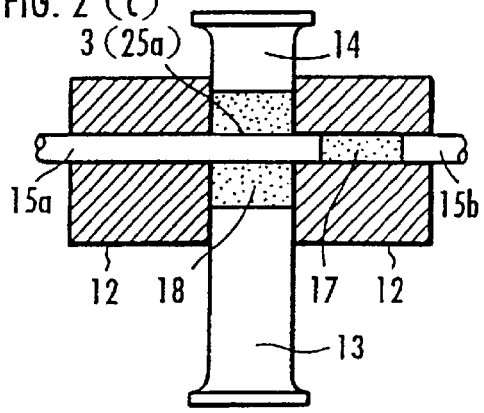
Figure 2:
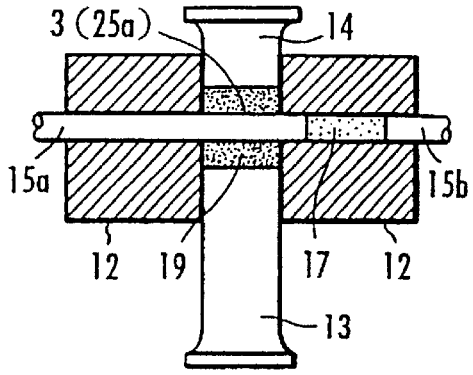
Figure 2:
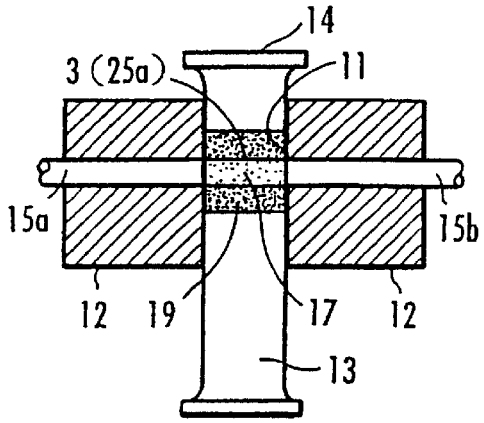
Figure 2:
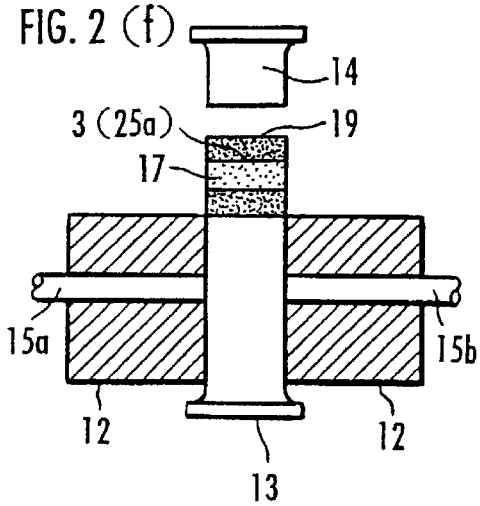

In this embodiment, as shown in FIG. 2(*a*), a device used for manufacturing the green compact shown in FIGS. 1 comprises a die 12 having a die hole 11 in a vertical direction, a lower punch 13 inserted from the underside of the die 12 into the die hole 11, and an upper punch 14 inserted from the upside of the die 12 into the die hole 11. Both of the punches are provided to ascend and descend freely.

The die hole 11 has a shape matching the vertical contour of the green compact when the axis hole 3 of the green compact shown in FIG. 1 is disposed horizontally. In the die 12, a punch-out pin 15*a* and a refill pin 15*b* in a shape corresponding to a cross-section of the axis hole 3 are provided to face the die hole 11, opposing to each other.

In this device, the die 12, the lower punch 13, the upper punch 14, the punch-out pin 15*a*, and the refill pin 15*b* are controlled by a not-shown controller. A microcomputer including CPU, RAM, ROM, and the like is utilized as the controller.

Next, a manufacturing method of this embodiment will be explained with reference to FIG. 2(*a*) to FIG. 2(*f*).

As shown in FIG. 2(*a*), an upper surface of the lower punch 13 is positioned at a lower part in the die hole 11 of the die 12 thereby forming a cavity 16 of the die hole 11 and the lower punch 13. On this occasion, the upper punch 14 is kept on standby above the die hole 11 and the punch-out pin 15*a* and the refill pin 15*b* are kept on standby at positions in which their ends face the die hole 11.

The cavity 16 is then filled with material powder 17 by a not-shown feeder. Powder of ferrous metals and the like can be utilized as the material powder 17.

Thereafter, as shown in FIG. 2(*b*), the upper punch 14 descends and temporarily compresses the material powder 17 which is filled in the cavity 16 between the upper punch 14 and the lower punch 13 so as to form a preform 18. Such a degree of the temporary compression that the material powder 17 can be maintained in the shape of the preform 18 is enough, and excessive compression is not necessary. The temporary compression is generally carried out to compress the material powder 17 by 20 to 30%.

Then, as shown in FIG. 2(*e*), the punch-out pin 15*a* is inserted into the preform 18 to punch out a shape of the axis hole 3. The refill pin 15*b* moves backward in synchronization with the forward movement of the punch-out pin 15*a*. As the result, the punch-out pin 15*a* is inserted to a part in the die 12 where the refill pin 15*b* has been disposed. The material powder 17 (a part of the preform 18) punched out of the preform 18 by the punch-out pin 15*a* is retracted to a part in the die 12, where the refill pin 15*b* has been moved backward, while the material powder 17 is being sandwiched between the punch-out pin 15*a* and the refill pin 15*b*. The material powder 17 is stored in the die 12.

The preform 18 is then pressurized and compressed between the upper punch 14 and the lower punch 13 while the punch-out pin 15*a* is being inserted therein as shown in FIG. 2(*d*), so as to finally form a green compact 19 having the shape shown in FIG. 1(*a*) or FIG. 1(*b*).

Subsequently, the punch-out pin 15*a* is pulled out from the green compact 19 as shown in FIG. 2(*e*). On this occasion, if the die 12 and the upper punch 14 are slightly raised in advance, an inner stress caused in the green compact 19 by the pressurization and compression is released, which allows the punch-out pin 15*a* to be pulled out easily.

When the punch-out pin 15*a* moves backward, in synchronization with the backward movement, the refill pin 15*b* moves forward. The ends of the punch-out pin 15*a* and the refill pin 15*b* are returned to the state in which they face the die hole 11 as shown in FIG. 2(*e*).

As the result, the material powder 17 which has been stored in the die 12 while being sandwiched between the punch-out pin 15*a* and the refill pin 15*b* is pushed by the refill pin 15*b* to be refilled into the axis hole 3 of the green compact 19.

Then, as shown in FIG. 2(*f*), the die 12 descends while the green compact 19 is being lightly sandwiched between the upper punch 14 and the lower punch 13 to knock out the green compact 19 and the upper punch 14 ascends and moves to the upper part of the die hole 11 so that the green compact 19 is released.

Since the temporarily compressed powder material 17 is refilled into the axis hole 3, the thin part of the base part 1 of the green compact 19 is reinforced. Therefore, even if the green compact is released as described above, breakage is not caused in the thin part and a product in a complete shape can be obtained.

After being taken out from the die, the green compact 19 can be made into the shape shown in FIG. 1(*a*) or FIG. 1(*b*) by removing the powder material 17 refilled into the axis hole 3 and sintering the green compact 19. Since the powder material 17 is not integrated with the green compact 19 but only filled in the axis hole 3, it can be removed easily by air blowing or the like.

Subsequently, a case of manufacturing P/M product in a shape shown in FIG. 3(*a*) will be explained as a second embodiment according to the present invention. The product shown in FIG. 3(*a*) is utilized as a machine part as described above, composed of a hook part 22 provided at the front end of a rod part 21 and a pair of parallel leg parts 24, 24 connected continuously at abase part 23 which is the rear end of the rod part 21, and has an undercut part 25 between the leg parts 24, 24 as described above.

Figure 3:
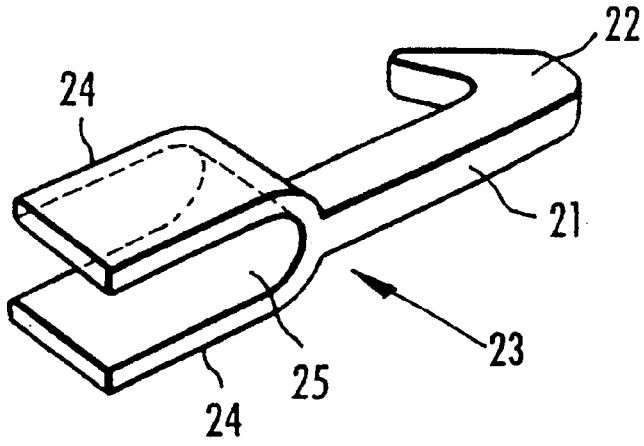
FIGS. 3(*a*) and 3(*b*) are perspective views showing another example of the green compact.
Figure 3:
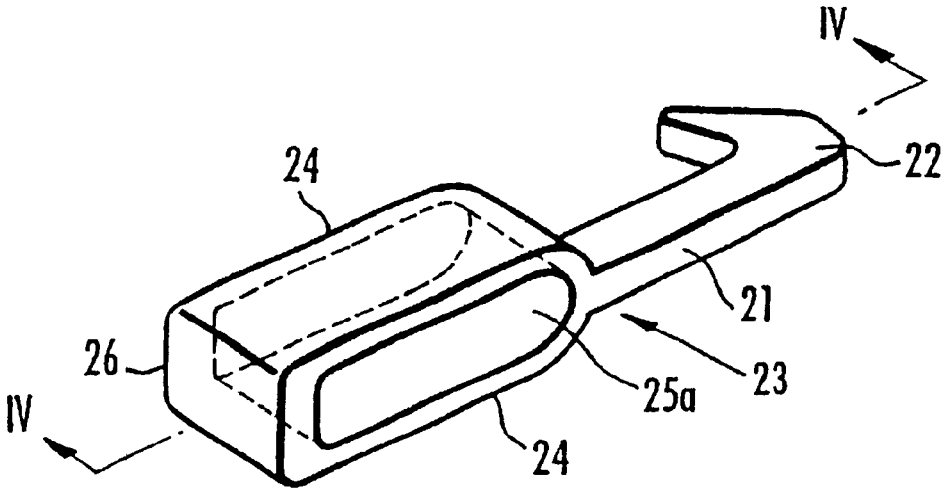

In order to get the product in a shape shown in FIG. 3(*a*) in this embodiment, a green compact shown in FIG. 3(*b*) is first manufactured. The green compact shown in FIG. 3(*b*) is so structured that the leg parts 24, 24 are connected at a connection part 26 provided at a part facing the base part 23, and the undercut part 25 shown in FIG. 3(*a*) is varied to a through-hole 25*a* surrounded by the leg parts 24, 24 and the connection part 26. As the result, the through-hole 25*a* is connected continuously to the base part 23 and has a shape including the parallel parts 24, 24 extending from the base part 23.

Since the green compact shown in FIG. 3(*b*) has the same structure as that of the green compact shown in FIG. 1(*a*) and FIG. 1(*b*) except that the axis hole 3 is varied to the through-hole 25, it can be formed in the same method as that of the aforesaid first embodiment, in accordance with the steps in FIG. 2(*a*) to FIG. 2(*f*).

In this embodiment, a thin part around the through-hole 25*a* (specifically, the leg part 24 in FIG. 3(*b*)) of the green compact 19 shown in FIG. 2(*f*) is reinforced because the temporarily compressed powder material 17 is refilled into the through-hole 25*a*. Accordingly, even if the green compact is taken out in the aforesaid releasing way, the thin leg part 24 does not break.

After the green compact 19 is taken out, it can be made into the shape in FIG. 3(*b*) by removing the powder material 17 refilled into the through-hole 25*a* Since the powder material 17 is not integrated with the green compact 19 but only filled in the through-hole 25*a*, it can be removed easily by air blowing or the like.

Then, by sintering the green compact 19, a compacted body in which the powder material 17 is mutually combined can be obtained. The leg parts 24, 24 are connected by the connection part 26 and an excellent parallel state can thus be obtained without causing deformation such as warpage in the sintering.

Figure 4:
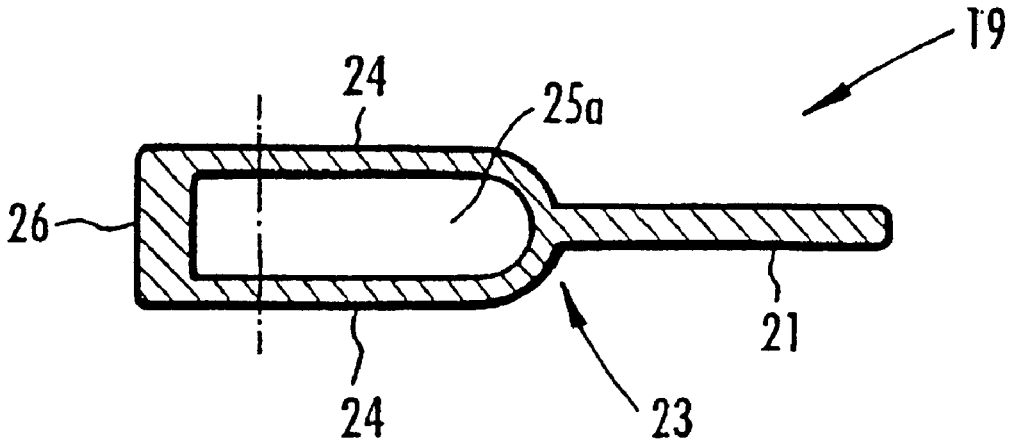
FIG. 4 is a cross-sectional view taken along a line IV—IV in FIG. 3(*b*)

Thereafter, the sintered compact 19 is cut at the position of a virtual line shown in FIG. 4 to cut off the connection part 26. As the result, a side of the through-hole 25*a* which faces the base part 23 is opened so that, as shown in FIG. 3(*a*), a desired product (a second sintered product) comprising a pair of parallel leg parts 24, 24 connected continuously at the base part and having the undercut part 25 formed between the leg parts 24, 24 can be obtained.

Since only the connection part 26 is cut off, the undercut part 25 can be formed much more easily than in the case of performing cutting work and the like on a massive green compact. The cut-off of the connection part 26 can be performed by a device which is generally known by itself Although the through-hole 25*a* has the shape including the parallel parts 24, 24 extending form the base part 23 in this embodiment, the shape of the through-hole 25*a* is not limited to this, and the pair of leg parts 24, 24 of the green compact are not limited to the parallel ones.

Figure 5:
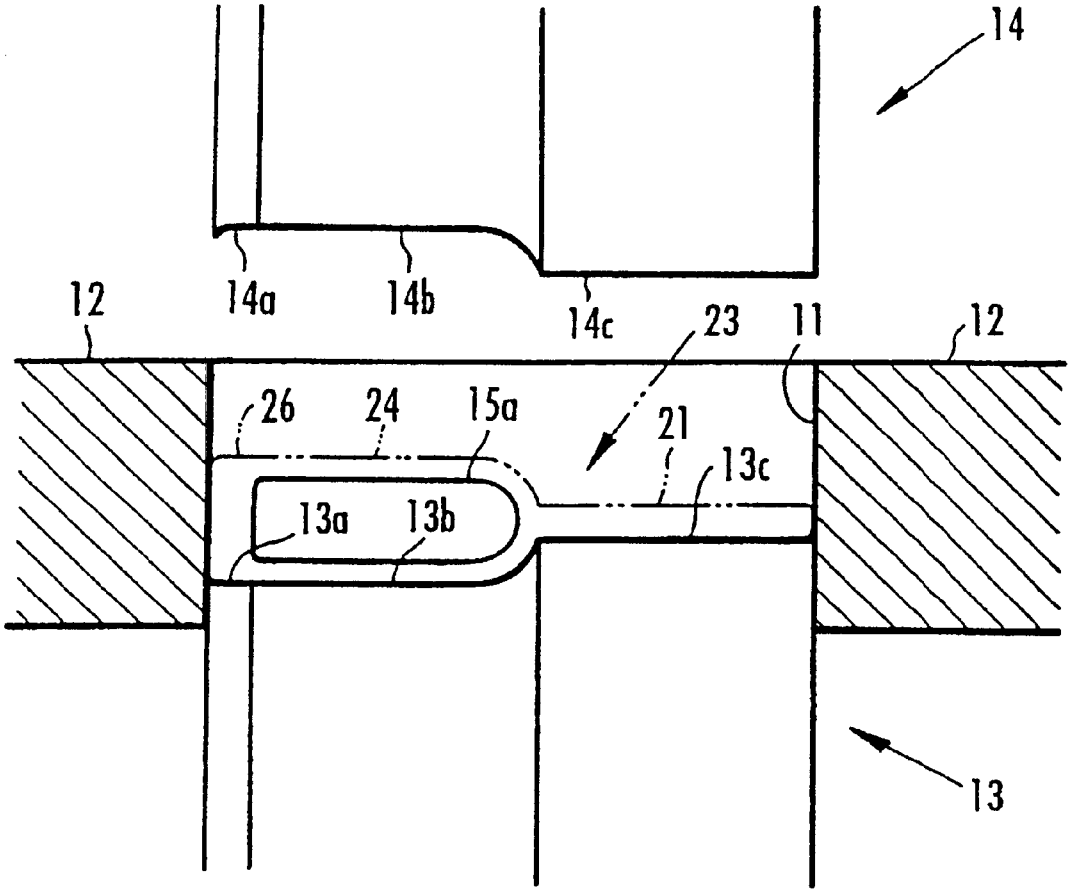
FIG. 5 is a cross-sectional view taken along a line V—V in FIG. 2(*a*).

In each of the embodiments, as shown in FIG. 2(*a*) to FIG. 2(*f*), the lower punch 13 and the upper punch 14 are explained as singular punches, but the lower punch 13 and the upper punch 14 may be divided into several parts corresponding to the shape of the green compact. For example, in a case of shaping the green compact shown in FIG. 3(*b*), the connection part 26 of the green compact shown in FIG. 3(*b*) is formed by a lower punch 13*a* and an upper punch 14*a*, the leg part 24 is formed by a lower punch 13*b* and an upper punch 14*b*, and the rod part 21 including the not-shown hook part 22 is formed by a lower punch 13*c* and an upper punch 14*c* as shown in FIG. 5. Each of the punches is provided to ascend and descend freely and independently.

Furthermore, in each of the embodiments, when the punch-out pin 15*a* is inserted into the preform 18 to punch out the shape of the axis hole 3 or the through-hole 25*a*, the punched-out material powder 17 is stored in the die 12, and when the punch-out pin 15*a* is pulled out, the material powder 17 is refilled into the axis hole 3 or the through-hole 25*a*. However, it is not always necessary for the punched-out material powder 17 to be refilled into the axis hole 3 or the through-hole 25*a* and, for example, the punched-out material powder 17 may be fallen into and collected in a hollow which is provided in the die 12. The collected material powder 17 can thereby be recycled.

INDUSTRIAL APPLICABILITY

The present invention can be utilized for manufacturing a green compact having a through-hole or an undercut part.

What is claimed is:

1. A method for manufacturing a green compact, comprising:

a step of filling material powder into a cavity formed of a die having in a vertical direction a die hole in a shape matching a contour of said green compact including a through-hole at a part connected continuously to a base part and a lower punch inserted from an underside of said die into said die hole;

a step of obtaining a preform by temporarily compressing the material powder filled in said cavity by means of an upper punch inserted from an upside of said die into said die hole and said lower punch;

a step of punching out a shape of said through-hole by inserting a punch-out pin having a shape corresponding to a cross-section of said through-hole into said preform;

a step of obtaining said green compact by pressurizing and compressing said preform by means of both of said upper and lower punches in a state in which said punch-out pin is being inserted;

a step of pulling out said punch-out pin from said green compact; and a step of taking out said green compact from said cavity.

2. A method for manufacturing a green compact according to claim 1, further comprising:

a step of sintering said green compact taken out from said cavity; and a step of forming a pair of leg parts connected continuously at said base part and an undercut part formed between both of said leg parts by cutting off a part of a peripheral wall forming said through-hole of said sintered compact.

3. A method for manufacturing a green compact according to claim 2, wherein said through-hole includes a pair of parallel parts extending from said base part, said step of forming a pair of parallel leg parts connected continuously at said base part and an undercut part formed between both of said leg parts is performed by cutting off a part facing said base part from the peripheral wall which forms said through-hole.

4. A method for manufacturing a green compact according to any one of claim 1 to claim 3, further comprising:

a step of retracting and storing the material powder, which is punched out in said step of punching out a shape of said through-hole by inserting a punch-out pin into said preform, outward of the cavity;

a step of refilling the stored material powder into said through-hole from which said punch-out pin has been pulled out in said step of pulling out the punch-out pin from the green compact; and a step of removing the material powder refilled into said through-hole after said step of taking out said green compact from said cavity.

5. A device for manufacturing a green compact, comprising:

a die having in a vertical direction a die hole in a shape matching a contour of the green compact including a through-hole at a part connected continuously to abase part;

a lower punch inserted from an underside of said die into said die hole and forming a cavity to be filled with material powder together with said die, an upper punch inserted from an upside of said die into said die hole and pressurizing and compressing the material powder filled in said cavity together with said lower punch;

a punch-out pin having a sectional shape corresponding to a cross-section of said through-hole, provided in said die to face said cavity, and inserted into a preform formed by temporarily compressing the material powder by means of both of said upper and lower punches to punch out a shape of said through-hole; and a refill pin having a sectional shape corresponding to the cross-section of said through-hole, provided in said die to face said cavity and to face said punch-out pin, moving backward in synchronization with forward movement of said punch-out pin when said punch-out pin is inserted into the preform, and moving forward in synchronization with backward movement of said punch-out pin when said punch-out pin is pulled out from the preform to refill the material powder into said through-hole.

* * * * *